US006581894B1

(12) United States Patent
Tong

(10) Patent No.: US 6,581,894 B1
(45) Date of Patent: Jun. 24, 2003

(54) DISPLAY DEVICE FOR ARTICLE FOR SALE

(76) Inventor: Hui Lin Tong, No. 37, Jong Liau Road, Jong Liau Li, Bei Dou Town, Chang Hua Hsien (TW), 521

( * ) Notice: Subject to any disclaimer, the term of this patent is extended or adjusted under 35 U.S.C. 154(b) by 0 days.

(21) Appl. No.: 10/256,292

(22) Filed: Sep. 30, 2002

(51) Int. Cl.[7] ..... A47F 5/00

(52) U.S. Cl. ..... 248/314; 211/70.6; 206/378; 206/806

(58) Field of Search ..... 248/314, 317, 248/225.11, 224.8, 309.1, 316.2; 211/70.6, 59.1; 206/378, 806, 349, 493, 461

(56) References Cited

U.S. PATENT DOCUMENTS 5,425,519 A * 6/1995 Budert ..... 248/214
5,467,874 A * 11/1995 Whitaker ..... 206/378
5,740,911 A * 4/1998 Chou ..... 206/378
5,862,913 A * 1/1999 Chou ..... 206/378
5,897,001 A * 4/1999 Dembicks ..... 211/70.6
6,032,797 A * 3/2000 Kao ..... 206/378
6,070,745 A * 6/2000 Dembicks ..... 211/70.6
6,250,466 B1 * 6/2001 Ernst ..... 206/378
6,386,363 B1 * 5/2002 Huang ..... 206/378
6,415,933 B1 * 7/2002 Kao ..... 211/70.6
6,464,840 B1 * 10/2002 McCann ..... 206/376

* cited by examiner

*Primary Examiner*—Leslie A. Braun
*Assistant Examiner*—Kofi Schulterbrandt
(74) *Attorney, Agent, or Firm*—Charles E. Baxley

(57) ABSTRACT

A display device includes a housing for engaging into an article and having one or more projections formed in the outer peripheral portion for engaging into the article and for locking the housing to the article. A casing is secured on the housing. A hanger device has a block rotatably received in the casing, a board secured on the block, and an actuator attached to the block and engageable into the housing and rotatable force the projections to lock the block to the article. The board has an edge to be engaged into the casing and to be locked to the casing.

6 Claims, 5 Drawing Sheets

DISPLAY DEVICE FOR ARTICLE FOR SALE

BACKGROUND OF THE INVENTION

1. Field of the Invention

The present invention relates to a display device, and more particularly to a display device having a lockable and reusable configuration.

2. Description of the Prior Art

Typical display devices or hanging devices may be used for hanging the articles for sale onto the supporting walls or the like. Some of the typical display devices comprise an insert or a plug for engaging into an opening of an article for sale. A lock device is engaged into the plug for forcing the plug to engage with the article, and a hook may be engaged through the plug for locking the plug and the article together. The article may be removed or disengaged from the plug only after the hook has been damaged or cut off from the lock device.

However, when or after the hook has been damaged or cut off from the lock device, the lock device may no longer be secured to the plug, and thus the article also may not be secured to the plug, such that the article may no longer be hung onto the supporting wall again with the plug and the plate.

The present invention has arisen to mitigate and/or obviate the afore-described disadvantages of the conventional display devices.

SUMMARY OF THE INVENTION

The primary objective of the present invention is to provide a display device including a lockable configuration for locking an article for sale and for preventing the article from being taken by the unauthorized persons.

The other objective of the present invention is to provide a display device including a reusable configuration for allowing the article to be hung onto a support with the display device after the article is unlocked from the display device.

In accordance with one aspect of the invention, there is provided a display device for securing to and for displaying an article, the display device comprising a plug device including a housing for engaging into the article and having a chamber formed therein and having an outer peripheral portion having at least one projection extended therefrom for engaging into the article, and for locking the plug device to the article, a casing provided on the housing, and having a space formed therein, a partition provided between the housing and the casing and having a slot formed therein, a hanger device including a block rotatably received in the space of the casing, a board provided on the block and rotated in concert with the board, an actuator attached to the block and engageable through the slot of the partition, and rotatably engaged in the chamber of the housing, and rotatable to align with the at least one projection for forcing the at least one projection into the article, and rotatable away from the at least one projection for allowing the at least one projection to be disengaged from the article, and means for locking the hanger device to the housing when the actuator is aligned with the at least one projection.

The housing includes an orifice formed in the partition and communicating with the slot of the partition, the actuator includes a neck secured thereto and rotatably received in the orifice of the partition.

The board includes an edge, the locking means includes a notch formed in the casing for receiving the edge of the board and for locking the board to the casing.

The casing includes at least one wedge formed beside the notch thereof, for slidably engaging with the edge of the board, and for allowing the edge of the board to be moved over the at least one wedge and to be engaged into the notch of the casing.

The casing includes a slit formed therein and communicating with the notch thereof, for increasing a resilience of the casing.

The casing includes an opening formed therein and communicating with the slit thereof for further increasing the resilience of the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
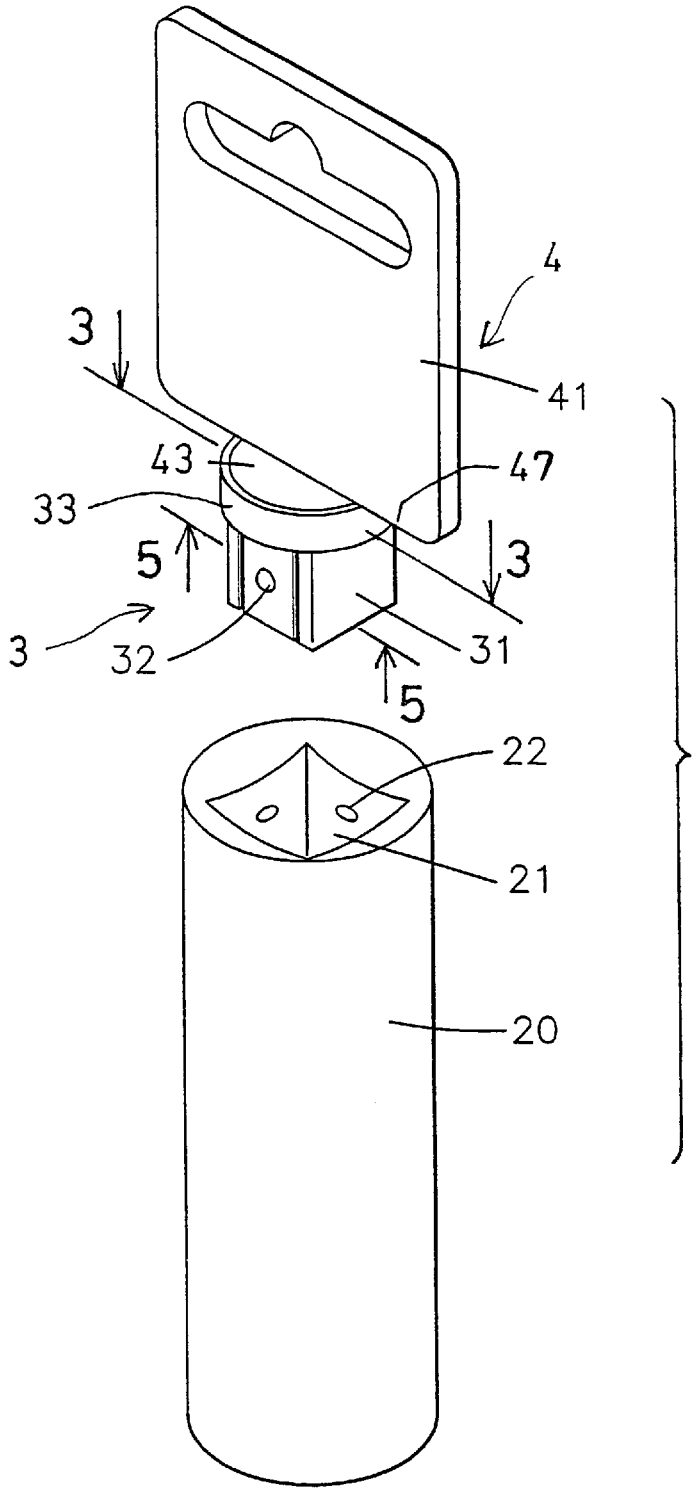
FIG. 1 is a partial exploded view illustrating a display device in accordance with the present invention for attaching onto an article.
Figure 2:
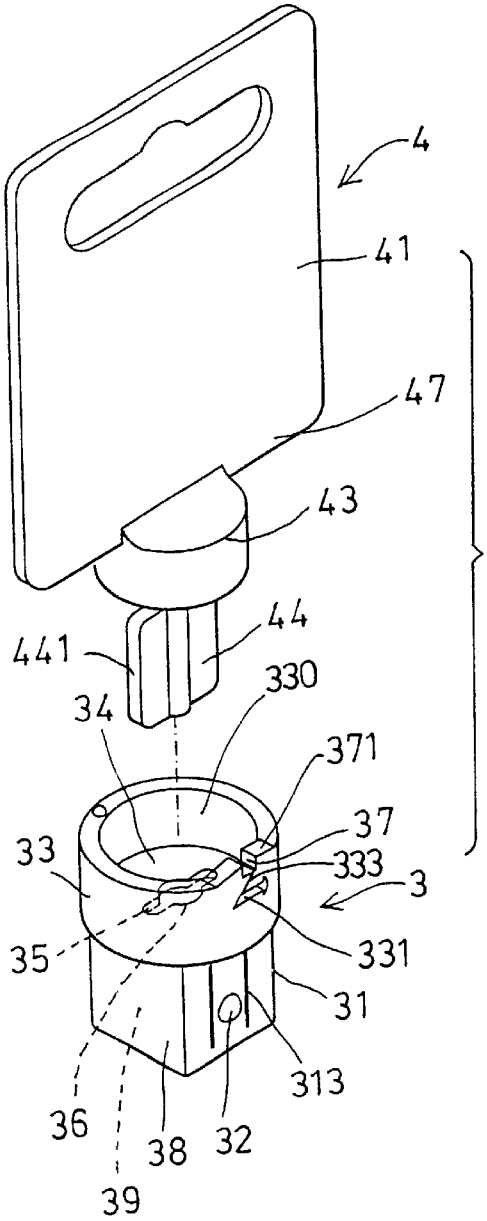
FIG. 2 is a partial exploded view of the display device.
Figure 3:
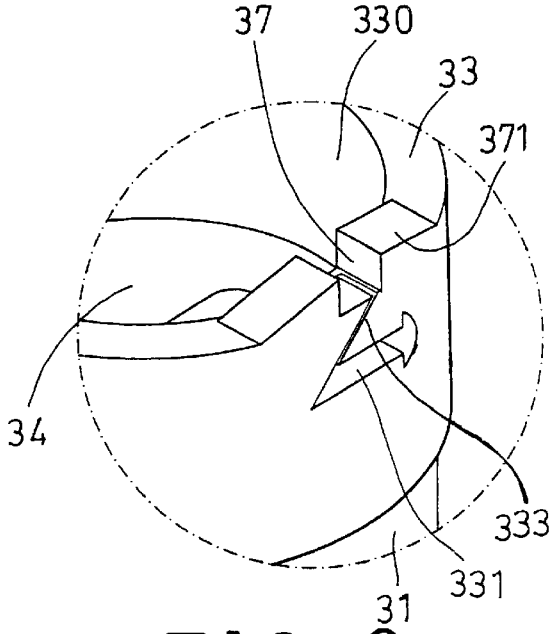
FIG. 3 is an enlarged partial perspective view of the display device.
Figure 4:
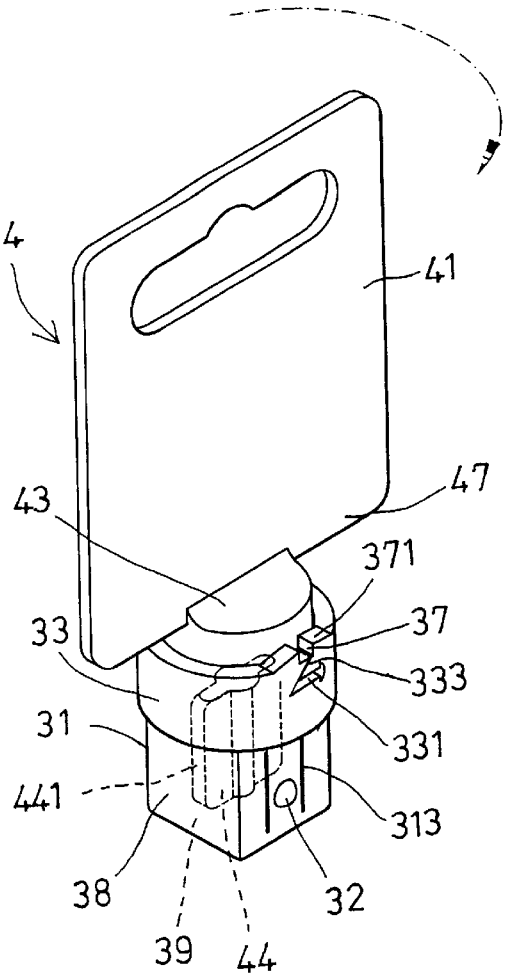
FIGS. 4, 5 are perspective views illustrating the operation of the display device.
Figure 5:
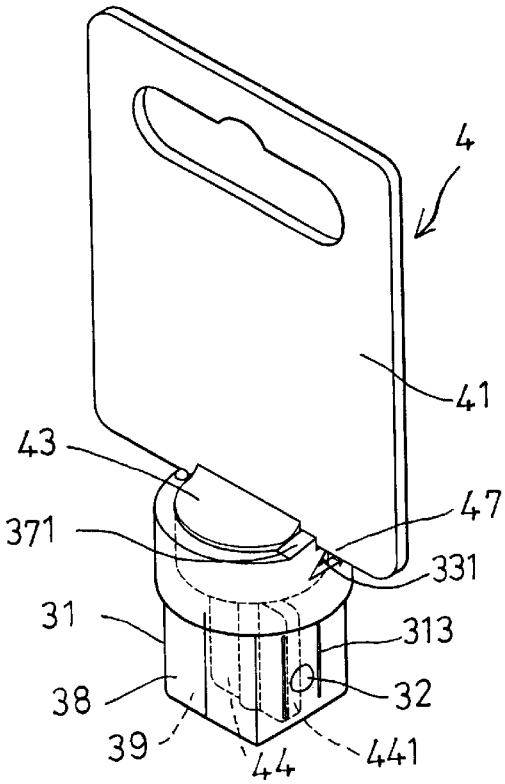
Figure 6:
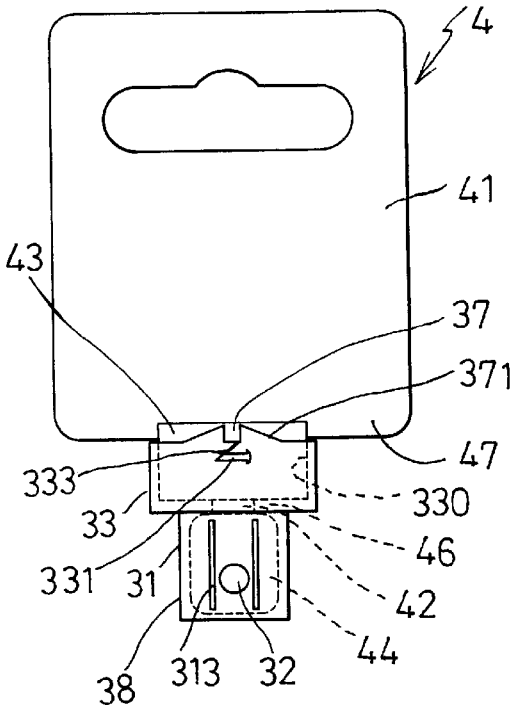
FIGS. 6, 7 are plan views illustrating the display device as shown in FIGS. 4, 5 respectively.
Figure 8:
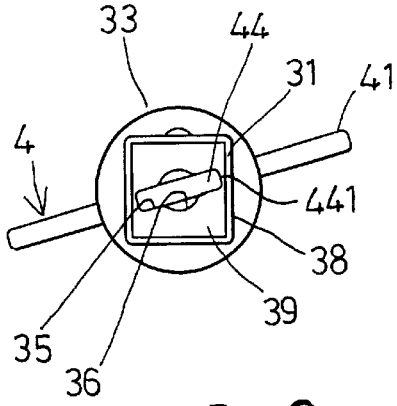
FIGS. 8, 9 are bottom views illustrating the display device as shown in FIGS. 4, 5; or 6, 7 respectively.
Figure 7:
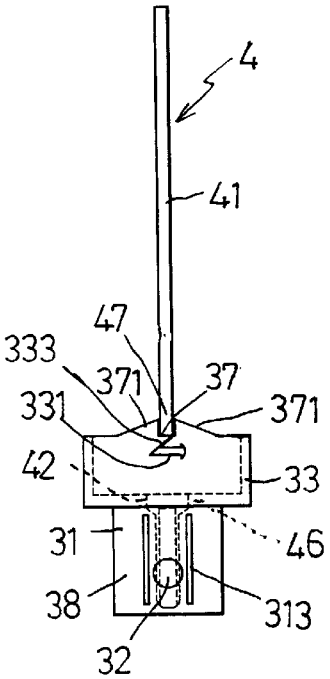
Figure 9:
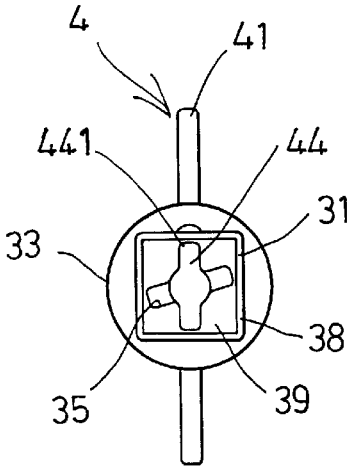

Referring to the drawings, and initially to FIGS. 1–9, a display device in accordance with the present invention comprises an article 20, such as a socket 20 to be displayed and to be hung onto a supporting wall or the like for displaying or marketing purposes. The article 20 includes a cavity 21 and one or more depressions 22 formed therein and communicating with each other.

The display device includes a plug device 3 having a housing 31 to be engaged into the cavity 21 of the article 20. The housing 31 preferably includes a non-circular cross section, and includes a chamber 39 formed therein and formed or defined by a peripheral wall 38.

The plug device 3 includes one or more projections 32 extended laterally outward from the peripheral wall 38 and preferably having a semi-spherical structure, and includes one or mote grooves 313 formed in the outer peripheral portion of the peripheral wall 38 for increasing the resilience of the peripheral wall 38 and of the projections 32, for allowing the projections 32 to be engaged into the depressions 22 of the article 20.

A casing 33 is formed or provided or disposed or secured on top of the housing 31 and includes a space 330 formed therein, and includes one or more notches 37 formed therein and communicating with the space 330 of the casing 33, and formed or defined between two ramps or wedges 371 of the casing 33.

The casing 33 further includes an opening 331 formed therein, preferably laterally formed therein, and a slit 333 inclined relative to the longitudinal direction of the casing 33, and inclined relative to the opening 331 and the notch 37 of the casing 33, for allowing the opening 331 and the slit 333 and the notch 37 of the casing 33 to form a substantially "Z" shaped structure.

A partition 34 is formed or provided between the housing 31 and the casing 33, and includes a slot 35 and an orifice 36 formed therein and communicating with each other. The slot 35 of the partition 34 is somewhat diagonal relative to the housing 31, and includes a width smaller than the diameter of the orifice 36 of the partition 34.

A hanger device 4 includes a board 41 for hanging onto the supporting walls or the like, and includes a block 43 secured to the lower portion of the board 41, and an actuator 44 secured to the block 43. The actuator 44 includes a width equals to or smaller than that of the slot 35 of the partition 34, for allowing the actuator 44 to be engaged through the slot 35 and to be engaged into the chamber 39 of the housing 31.

A neck 42 (FIGS. 6, 7) is formed between the-board 41 and the block 43, and includes a circular cross section and includes a diameter equals to or smaller than that of the orifice 36 of the partition 34, for allowing the neck 42 to be rotatably secured to the plug device 3. The plug device 3 and the hanger device 4 may be locked together after the actuator 44 is rotated relative to the housing 31.

It is preferable that the neck 42 includes a thickness no less than that of the thickness of the partition 34, for allowing the partition 34 to be engaged into the gap 46 that is formed between the block 43 and the actuator 44 (FIGS. 6, 7) and for allowing the actuator 44 to be rotated relative to the housing 31 after the actuator 44 has been engaged into the chamber 39 of the housing 31.

In operation, as shown in FIGS. 4–9, when the actuator 44 is rotated to engage its ends or sides 441 with the peripheral wall 38 and to align its sides 441 with the projections 32, the projections 32 may be forced into the depressions 22 of the article 20, for locking the article 20 to the housing 31 of the plug device 3.

When the actuator 44 has been rotated relative to the housing 31, the actuator 44 will be disengaged from or will be prevented from being aligned with the slot 35 of the partition 34, such that the actuator 44 may be prevented from moving through the slot 35 of the partition 34 and may be prevented from being disengaged from the housing 31 of the plug device 3.

In addition, when the board 41 is rotated relative to the casing 33, the bottom edge 47 of the board 41 may be moved over either of the ramps or wedges 371 and may then be stably received and retained in the notch 37 of the casing 33, such that the board 41 may be locked to the casing 33, and such that the hanger device 4 may be locked to the plug device 3, and such that the article 20 may be prevented from being disengaged and removed from the plug device 3 and the hanger device 4.

The formation or the provision of the opening 331 and the slit 333 in the casing 33 may suitably increase the resilience of the casing 33, for allowing the bottom edge 47 of the board 41 to be resiliently moved over either of the ramps or wedges 371 and to be stably received and retained in the notch 37 of the casing 33.

After displaying purposes, or after the user has bought the display device, either of the wedges 371 may be depressed relative to the casing 33 by such as the plier devices, or may be cut off from the casing 33. In this condition, the actuator 44 may also be rotated to align and to force the projections 32 into the depressions 22 of the article 20, for locking the article 20 to the housing 31 of the plug device 3.

However, after the wedges 371 have been cut from the casing 33, the board 41 may no longer be locked to the casing 33, such that the actuator 44 may still be rotated to engage with or to be moved away from the projections 32, for allowing the projections 32 to be disengaged from the depressions 22 of the article 20 and for allowing the article 20 to be disengaged from the housing 31 of the plug device 3.

Figure 11:
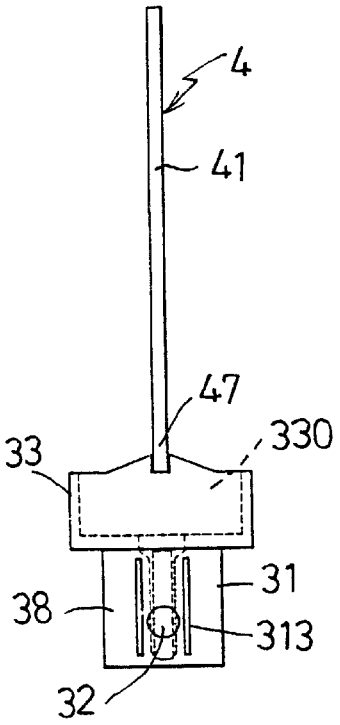
FIG. 11 is a plan view of the display device as shown in FIG. 10.
Figure 10:
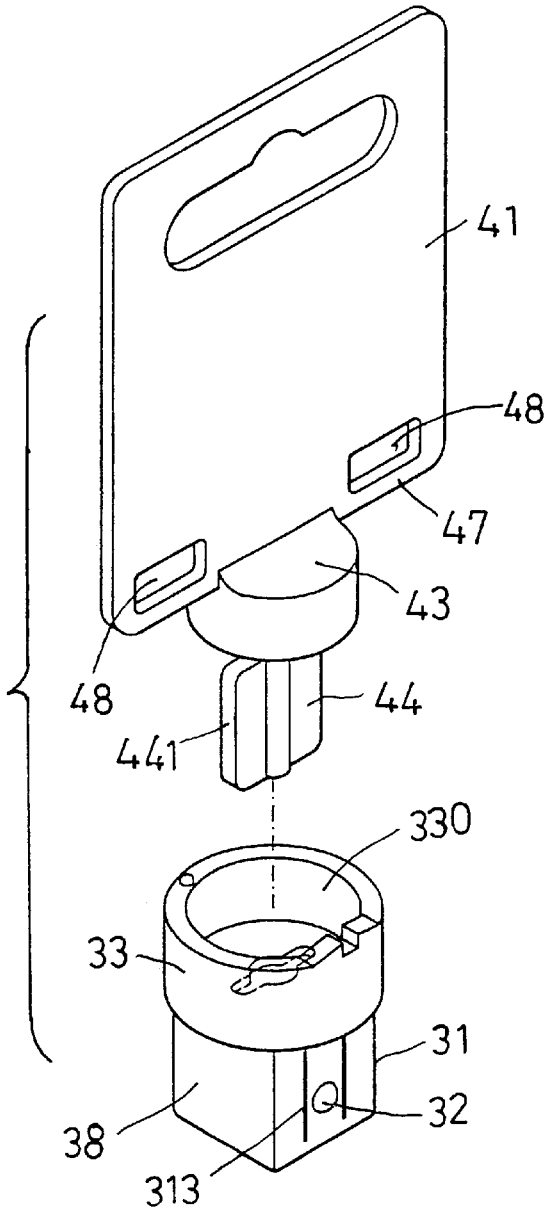
FIG. 10 is an exploded view illustrating the other embodiment of the display device.

Referring next to FIGS. 10 and 11, the casing 33 may also have the notch 37 and the ramps or wedges 371 formed thereon, without the opening 331 and the slit 333 formed therein. The casing 33 itself may be made of resilient materials, for allowing the bottom edge 47 of the board 41 to be resiliently moved over either of the ramps or wedges 371 and to be stably received and retained in the notch 37 of the casing 33.

As shown in FIG. 10, the board 41 may include one or more openings 48 formed in the bottom portion or region thereof, for increasing the resilience of the bottom edge 47 thereof.

Accordingly, the display device in accordance with the present invention includes a lockable configuration for locking an article for sale and for preventing the article from being taken by the unauthorized persons, and includes a reusable configuration for allowing the article to be hung onto a support with the display device after the article is unlocked from the display device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A display device for securing to and for displaying an article, said display device comprising:

a) a plug device including:

i) a housing for engaging into the article and having a chamber formed therein and having an outer peripheral portion having at least one projection extended therefrom for engaging into the article, and for locking said plug device to the article, ii) a casing provided on said housing, and having a space formed therein, iii) a partition provided between said housing and said casing and having a slot formed therein, b) a hanger device including:

i) a block rotatably received in said space of said casing, ii) a board provided on said block and rotated in concert with said board, iii) an actuator attached to said block and engageable through said slot of said partition, and rotatably engaged in said chamber of said housing, and rotatable to align with said at least one projection for forcing said at least one projection into the article, and rotatable away from said at least one projection for allowing said at least one projection to be disengaged from the article, and.

c) means for locking said hanger device to said housing when said actuator is aligned with said at least one projection.

2. The display device according to claim 1, wherein said housing includes an orifice formed in said partition and communicating with said slot of said partition, said actuator includes a neck secured thereto and rotatably received in said orifice of said partition.

3. The display device according to claim 1, wherein said board includes an edge, said locking means includes a notch formed in said casing for receiving said edge of said board and for locking said board to said casing.

4. The display device according to claim 3, wherein said casing includes at least one wedge formed beside said notch thereof, for slidably engaging with said edge of said board, and for allowing said edge of said board to be moved over said at least one wedge and to be engaged into said notch of said casing.

5. The display device according to claim 3, wherein said casing includes a slit formed therein and communicating with said notch thereof, for increasing a resilience of said casing.

6. The display device according to claim 5, wherein said casing includes an opening formed therein and communicating with said slit thereof for further increasing the resilience of said casing.

* * * * *